US008915354B1

(12) United States Patent
Smith

(10) Patent No.: US 8,915,354 B1
(45) Date of Patent: Dec. 23, 2014

(54) DEVICE FOR ARRANGING AND STORING JEWELRY HAVING ORGANIZING CLASPS

(71) Applicant: Dorothy A. Smith, Pompano Beach, FL (US)

(72) Inventor: Dorothy A. Smith, Pompano Beach, FL (US)

( * ) Notice: Subject to any disclaimer, the term of this patent is extended or adjusted under 35 U.S.C. 154(b) by 14 days.

(21) Appl. No.: 13/855,040

(22) Filed: Apr. 2, 2013

Related U.S. Application Data

(63) Continuation-in-part of application No. 13/304,886, filed on Nov. 28, 2011, now abandoned.

(51) Int. Cl.

| | |
|---|---|
| ***A45C 11/04*** | (2006.01) |
| ***B65D 73/00*** | (2006.01) |
| ***B65D 30/22*** | (2006.01) |
| ***A45C 11/16*** | (2006.01) |

(52) U.S. Cl.
CPC ..... *A45C 11/16* (2013.01)
USPC ..... 206/6.1; 206/495; 383/39

(58) Field of Classification Search
CPC .. B65D 31/12; B65D 81/3261; B65D 85/187; A45C 3/122; A45C 11/16; A47F 7/02; A47G 25/005
USPC ..... 206/6.1, 278, 495; 383/38–40
See application file for complete search history.

(56) References Cited

U.S. PATENT DOCUMENTS

| | | | | |
|---|---|---|---|---|
| 1,418,403 | A | 6/1922 | Smith | |
| 1,909,942 | A | 5/1933 | Fingerman | |
| 2,899,997 | A | 8/1959 | Rauen | |
| 3,139,133 | A | 6/1964 | Spector | |
| 3,207,421 | A | 9/1965 | Hunger et al. | |
| 3,949,916 | A | 4/1976 | Yount | |
| 4,401,219 | A | 8/1983 | Mink | |
| 4,580,667 | A | 4/1986 | Herwood | |
| 5,121,833 | A | 6/1992 | Lindsay et al. | |
| 5,209,344 | A | 5/1993 | Smith | |
| 5,246,103 | A | 9/1993 | Hicks | |
| 5,385,237 | A | 1/1995 | Mathews | |
| 5,427,230 | A | 6/1995 | Mattox | |
| 5,692,604 | A | 12/1997 | Houk | |
| 5,779,033 | A | 7/1998 | Roegner | |
| 8,627,950 | B2 * | 1/2014 | Bland | 206/6.1 |

* cited by examiner

*Primary Examiner* — Bryon Gehman

(74) *Attorney, Agent, or Firm* — Malin Haley DiMaggio & Bowen, P.A.

(57) ABSTRACT

A foldable and collapsible jewelry storage device including a flexible substratum having a top portion and two opposing substantially planar surfaces, a plurality of pockets disposed on at least one of the surfaces, and an attachment clasp disposed adjacent to a top edge of at least one of the pockets. A hanger is attached to the top portion of the substratum to provide a point of attachment to a rigid body, such as a closet rod. Each of the pockets comprises a flexible translucent strip attached to the substratum along at least the lower edge and sides of the strip, leaving the top edge open, forming a storage pocket. The pockets are spaced apart and arranged in a matrix or grid. The attachment clasp provides enhanced organization for longer jewelry pieces and prevents kinking and tangling. The substratum may comprise two layers with a hanger disposed between the two.

1 Claim, 3 Drawing Sheets

DEVICE FOR ARRANGING AND STORING JEWELRY HAVING ORGANIZING CLASPS

CROSS REFERENCED TO RELATED APPLICATIONS

This application is a continuation-in-part of co-pending U.S. patent application Ser. No. 13/304,886 filed on Nov. 28, 2011.

BACKGROUND OF THE INVENTION

1. Field of the Invention

The present invention relates generally to a device for storing jewelry and more specifically to a collapsible and foldable jewelry storage device which allows the pieces of jewelry to be stored in an array and be visible to an observer while the jewelry is beings stored.

2. Description of Related Art

Traditionally, jewelry is stored in rigid boxes that often include one or more storage compartments or tiers. Usually the individual pieces of jewelry are stacked on top of each other or jumbled about within the storage box without any particular regard to organization or containment. Consequently, in order for the user to see the individual pieces of jewelry, the box must be opened and individual pieces manually removed. This often requires space around the boxes to allow room for the box to open for one to see its contents. Furthermore, ambient light does not readily shine into the box, making it difficult to see jewelry stored in the various tiers and compartments of the box.

More recently, hanging jewelry storage devices have been implemented. Such devices typically include a hanger or other hook means at the top thereof, from which a flexible panel hangs. The flexible panel often includes a variety of pockets or slot in which jewelry is placed for storage, which pockets may be transparent or translucent to render the jewelry visible even while stowed away. These flexible and hanging jewelry storage devices are often foldable, allowing for convenient storage of same. While the pocket arrangement of the hanging devices offer a substantial improvement over prior jewelry storage products, longer jewelry pieces like bracelets and necklaces will tend to get kinked or tangled when placed within the pockets. Such a result is unsightly and is of course inconvenient when a user wishes to retrieve a particular jewelry piece. Consequently, there is a need in the art to enhance hanging jewelry storage devices to provide a more functional, useful, and aesthetically pleasing configuration. It is, therefore, to the effective resolution of the aforementioned problems and shortcomings of the prior art that the present invention is directed. However, in view of the jewelry storage devices in existence at the time of the present invention, it was not obvious to those persons of ordinary skill in the pertinent art as to how the identified needs could be fulfilled in an advantageous manner.

SUMMARY OF THE INVENTION

The present invention provides a foldable and collapsible jewelry storage device, comprising a flexible substratum having a top portion and two opposing substantially planar surfaces, a plurality of pockets disposed on at least one of the surfaces, and an attachment clasp disposed adjacent to a top edge of at least one of the pockets. Of course, the pockets and attachment clasps could be disposed on both sides of the substratum. In some embodiments, a hanger is attached to the top portion of the substratum to provide a point of attachment to a rigid body, such as a closet rod. In some cases, each of the pockets comprises a flexible translucent strip attached to the substratum along at least the lower edge and sides of the strip, leaving the top edge open, forming a storage pocket. In some embodiments, the pockets are spaced apart and arranged in a matrix or grid. Also, the pockets may vary in size and shape, as desired.

In another embodiment, the present invention comprises a flexible substratum comprising two substantially planar substratum layers, each of the layers having a top portion, an outer surface, and an inner surface. A plurality of pockets is disposed on at least one of said outer surfaces and may be present on both outer surfaces, which surfaces are opposing one another. An attachment clasp may be disposed adjacent to a top edge of at least one of the pockets. In this embodiment, a hanger may be disposed between the two inner surfaces of the substratum layers, and secured by hook and loop fasteners, or other fastening means attached to the top portion of the two layers.

Accordingly, it is an object of the present invention to provide collapsible, foldable jewelry storage device that provides a means for organizing and storage jewelry pieces and other items while keeping the items visible to the user while stored.

It is another object of the present invention to provide a collapsible, foldable jewelry storage device that can be hung from a rigid body, such as a closet rod, for ease of use and convenience.

It is yet another objection of the present invention to provide a collapsible, foldable jewelry storage device that includes attachment clasps disposed adjacent to the top edge of each of the pockets, which clasps are configured to receive longer jewelry pieces or other items, to allow for storage of same without the risk of tangling, kinking, or damage thereto.

In accordance with these and other objects which will become apparent hereinafter, the instant invention will now be described with particular reference to the accompanying drawings.

DETAILED DESCRIPTION

Figure 1:
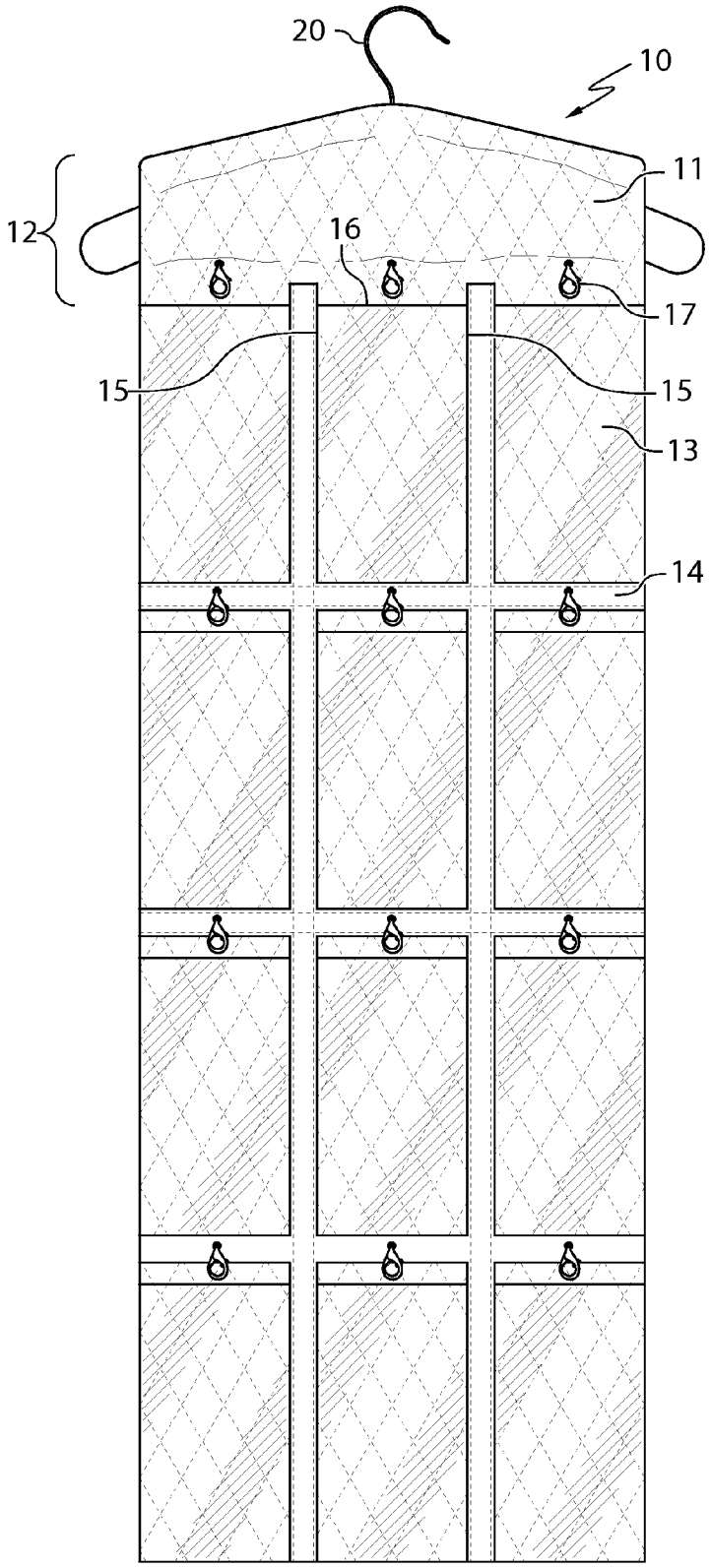
FIG. 1 is a front elevation view of one embodiment of the present invention.

FIG. 1 a front perspective view of one embodiment of the jewelry storage device 10 of the present invention. Jewelry storage device 10 comprises a flexible and foldable substratum 11 having a top portion 12. In some embodiments, flexible substratum 11 is a generally planar, flexible panel comprised of a quilted, padded, or matted cloth material. In some embodiments, substratum 11 is sewn or stitched around its perimeter to prevent fraying and to enhance appearance. Lace or other decorative materials may also be sewn around the perimeter substratum, to enhance appearance. It is appreciated that the material of the substratum may be of any suitable flexible material and may include any desired color, print, or pattern. A hanger 20 may be attached to or received in the top portion 12, for hanging the jewelry storage device 10 from a substantially rigid protrusion as desired, enhancing the usability and visibility of the device 10.

A plurality of pockets 13 are placed across the surface of substratum 11. In some embodiments, the pockets are comprised of a transparent and/or translucent material such as plastic so that objects stored therein are visible. In some embodiments, the pockets 13 are generally rectangular in shape, but other shapes may be used, such as squares or irregular shapes. The pockets 13 comprise flexible strips of translucent and/or transparent material which are attached to the substratum 11 along the lower edge 14 and sides 15 of the flexible strips. The pockets 13 may be attached by known means such as sewing or the like. The top edge 16 of each of the pockets 13 is preferably not attached to the substratum 11, thereby leavening an opening whereby jewelry pieces can be placed within pockets 13. The top edge may include fabric trim to provide a finished edge to protect the pocket 13 as well as the user. By attaching the pockets 13 at the lower edges 14 thereof, a natural fold line is created which aid in the folding and storage of the jewelry storage device 10. In some embodiments, the fold lines are uniform across the substratum, preventing overlaps and enhancing foldability.

In some embodiments, pockets 13 are arranged in a matrix configuration to provide order and arrangement of jewelry pieces placed within the pockets 13. For example, as shown in FIG. 1, one embodiment of the present invention includes twelve pockets 13 arranged in three columns of four pockets 13 each. The pockets 13 are generally spaced apart both horizontally and vertically in order to provide room for expansion of the pockets 13 as well as space for placing and removing jewelry items into the pockets 13. While the embodiments depicted herein demonstrate that the pockets 13 are uniform in shape and size, this generally need not be the case. Each pocket 13 in the matrix may have a different size and shape, however it is appreciated that having at least uniformly shaped pockets 13 across each row will create a uniform fold line across the lower edges 14 thereof, preventing overlaps and improving the overall foldability and stowability of the storage device 10.

Figure 2:
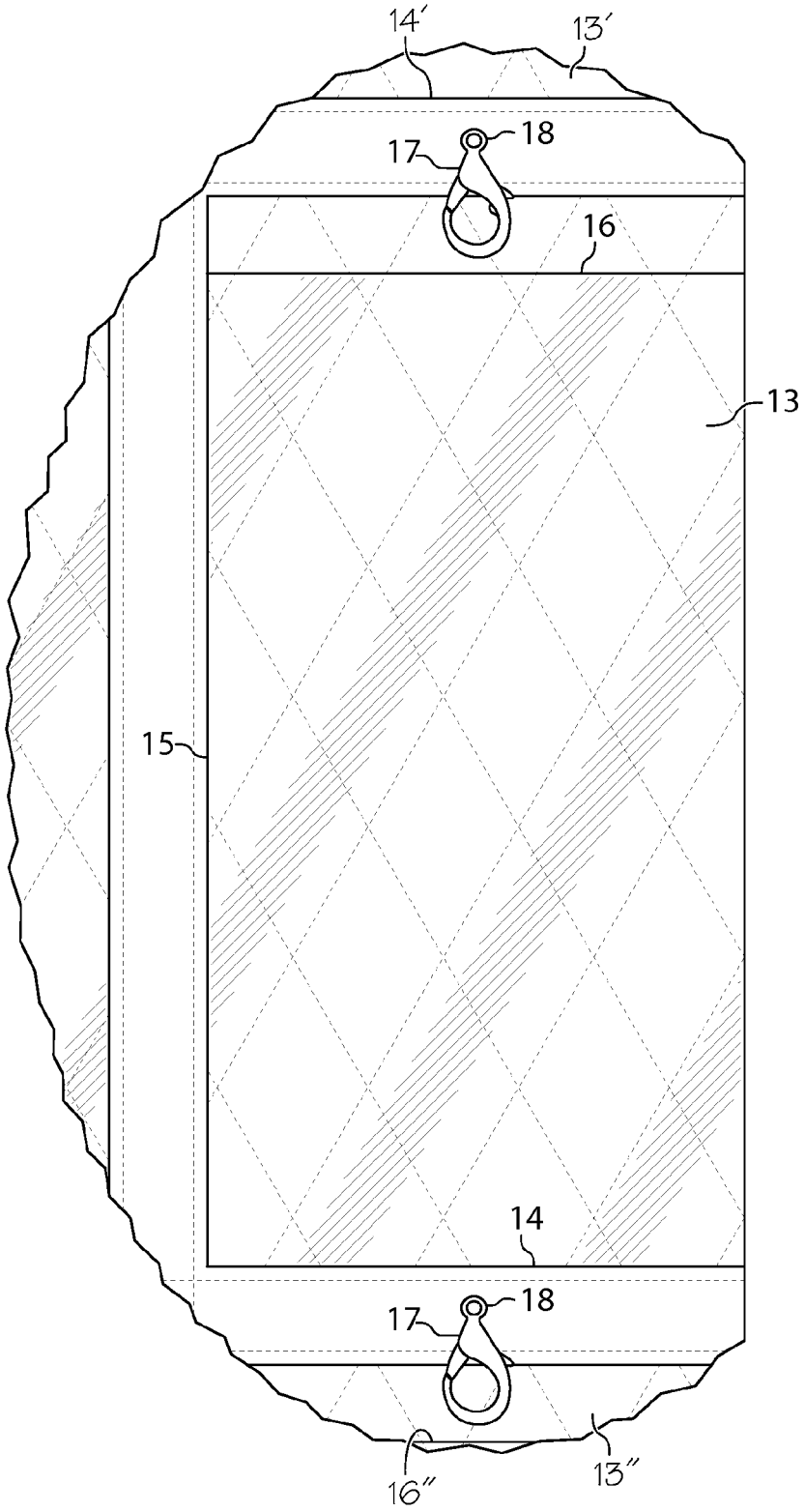
FIG. 2 is an expanded view of one aspect of the present invention.

With reference to FIG. 2, shown is an expanded view of a portion of the jewelry storage device 10 of the present invention. Shown is pocket 13 attached to substratum 11 at lower edge 14 and side 15 and having a top edge 16 that is not attached to substratum 16. Also shown in part is another pocket 13' above pocket 13, which pocket 13' includes a lower edge 14'. Further, also shown in another pocket 13" below pocket 13, which pocket 13" includes a top edge 16". Disposed between lower edge 14' of pocket 13' and top edge 16 of pocket 13 is an attachment clasp 17. Likewise, another attachment clasp 17 is disposed between lower edge 14 of pocket 13 and upper edge 16" of pocket 13". Accordingly, an attachment clasp 17 may be located adjacent to the top edge of at least one pocket 13 of the device 10 and, in some embodiments, a plurality of attachment clasps 17 may be provided, each located adjacent the top edge of each corresponding pocket. In some embodiments, the attachment clasps 17 are provided within the space above the top edges, it being understood that the pockets are vertically spaced apart as noted above. The attachment clasps 17 may be secured to the surface substratum 11 by a loop 18 or other attachment means.

Attachment clasps 17 may comprise a metal, plastic, or other suitably rigid material and are intended to receive longer jewelry items such as bracelets and necklaces in order to prevent kinking and tangling. Accordingly, in some embodiments, a bracelet or necklace is at least partially provided through attachment clasp 17, with the remainder of the bracelet or necklace placed within the pocket 13 there below such that the item remains untangled yet securely stowed away and contained. The attachment clasp feature improves functionality of the storage device, while also protecting long jewelry items and improving aesthetics. Of course, it is appreciated that other jewelry items and accessories can be received by attachment clasps 17; their functionality and usefulness is not merely limited storage and containment of bracelets and necklaces. The attachment clasps 17 may comprise "bocklebee clasps" or any clasp having a spring loaded release that provides access to the clasp. These releasable clasps provide a substantial advantage when attaching and removing jewelry items as the release allows for easy access.

It is appreciated that the jewelry storage device 10 of the present invention may include a plurality of pockets 13 on both sides thereof. In some embodiments, a single-ply configuration of substratum 11 is provided wherein each of the opposing sides of the generally planar substratum 11 includes pockets 13 and attachment clasps 17 as described above. It is appreciated that the size, shape and location of the pockets 13 and clasps 17 need not be identical with respect to both sides; however it is realized that aligning the lower edges 14 of each pocket 14 will provide a uniform fold line for easier folding and storage.

Figure 3:
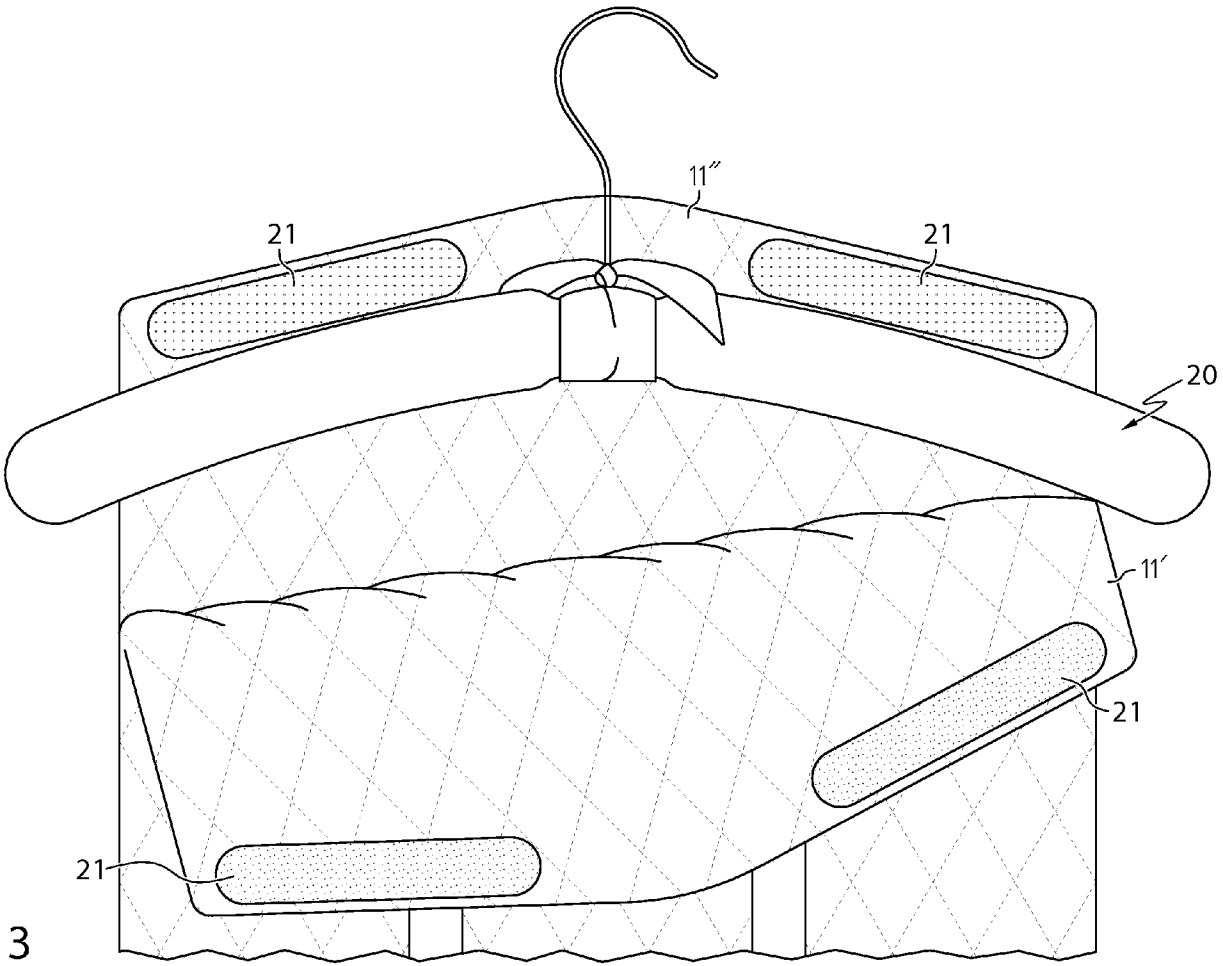
FIG. 3 is another expanded view of one aspect of the present invention.

In an alternate configuration, with reference to FIG. 3, the substratum 11 is two-ply, having a first substratum layer 11' and an opposing second substratum layer 11". The outwardly facing surfaces of both layers 11' and 11" include the same pockets 13 and attachment clasps 17 described above however the arrangement, size, and shape of such features need not be identical with respect to both layers. In this embodiment, at least a portion of the perimeter of substratum layers 11' and 11" are sewn or stitched to one another. In some embodiments, the top portion 12 of each of the layers 11' and 11" are removably attached to one another by one or more hook and loop fasteners 21 located on the respective opposing surfaces thereof. Accordingly, hanger 20 may be disposed between inside surfaces of the two layers 11' and 11" at the top portions 12 thereof and secured there between by the engagement of the corresponding hook and loop fasteners 21. It is appreciated that other removable attachment means may be used to secure the two the substratum layers 11' and 11" to each other, such as buttons, snaps, hooks, ties or the like. Hanger 20 can be utilized to hang the jewelry storage device 10 from a substantially rigid protrusion such as a closet rod or the like. Hanging the device 10 allows the entire substratum to hang substantially vertically, providing easy access to each of the pockets 13 while also providing visualization of the contents of each of the translucent and/or transparent pockets 13.

It is realized that the present invention provides a collapsible and foldable jewelry storage device 10 that includes at least two operative states, an open, and a folded state. The open state provides access to substantially all of the pockets 13 disposed on either side of the substratum 11 (or in the case of the two-play configuration, substratum layers 11' and 11"). In the open state, the device can be hung to a substantially rigid protrusion or other body by way of hanger 20. In a folded state, the device 10 may be collapsed and folded about the lower edged 14 thereof and may be folded several times, depending on the number and configuration of pockets 13. Accordingly, the entire device 10 can be collapsed and folded while still containing jewelry items, to allow a user to store and/or transport the entirety of the contents of the device 10 without having to remove any such contents. Furthermore, the attachment clasps 17 provide a significant advantage in containing and organizing longer jewelry pieces without the risk of kinking, tangling, or damage.

The instant invention has been shown and described herein in what is considered to be the most practical and preferred embodiments. It is recognized, however, that departures may be made therefrom within the scope of the invention and that obvious modifications will occur to a person skilled in the art.

What is claimed is:

1. A collapsible and foldable device for arranging and storing jewelry comprising:

a rectangular, flexible substratum having a length and height, said substratum having a top edge and two opposing substantially planar surfaces; a plurality of flexible transparent members attached to a first of said two opposing substantially planar surfaces, each of said first plurality of flexible members having a plurality of side edges and a top edge and a bottom edge, each of said first plurality of flexible members attached to said first substantially planar surface along their respective plurality of side edges and respect the bottom edge to form a first plurality of pockets on said first substantially planar surface to create a natural fold line at the bottom edge for aiding in compactly folding and storing said device, said top edge of each said first plurality of flexible members attached to said first substantially planar surface to provide access with respect to the respective pocket of said first plurality of pockets;

means attaching said substratum to a hanger along the top edge of said substratum, said hanger thereby supporting said substratum; and a respective rigid jewelry attachment releasable clasp disposed on said substratum adjacent the top edge of each of said pockets, each of the releasable clasps having a spring-loaded release that provides access to open said clasp.

* * * * *